US010508463B1

(12) United States Patent
Kennedy

(10) Patent No.: US 10,508,463 B1
(45) Date of Patent: Dec. 17, 2019

(54) SWIMMING POOL DEBRIS SCREENING ASSEMBLY

(71) Applicant: Stinson Kennedy, Prattville, AL (US)

(72) Inventor: Stinson Kennedy, Prattville, AL (US)

( * ) Notice: Subject to any disclaimer, the term of this patent is extended or adjusted under 35 U.S.C. 154(b) by 0 days.

(21) Appl. No.: 16/009,617

(22) Filed: Jun. 15, 2018

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.19
See application file for complete search history.

(56) References Cited

U.S. PATENT DOCUMENTS 3,372,809 A * 3/1968 Spitzer ..... E04H 4/1272 210/167.19
4,140,634 A 2/1979 Harry
4,332,683 A 6/1982 Alt
5,935,450 A * 8/1999 Benedict ..... E04H 4/1272 210/167.19
7,594,997 B1 9/2009 Kazarian
D619,773 S 7/2010 Diermayer
8,133,387 B2 3/2012 DePinto et al.
2005/0011819 A1 1/2005 Gillen
2007/0012607 A1* 1/2007 Mullner, Jr. ..... E04H 4/1272 210/167.1
2009/0188851 A1* 7/2009 DePinto ..... E04H 4/1254 210/167.2

FOREIGN PATENT DOCUMENTS

WO WO2004009934 1/2004

* cited by examiner

*Primary Examiner* — Fred Prince

(57) ABSTRACT

A swimming pool debris screening assembly for preventing clogs in a pool's water flow system includes a bracket that is sized to partially insert into an inlet of a pool skimmer of a pool. A first section of the bracket is frictionally coupled to the inlet and a second section of the bracket extends from the inlet into the pool. A grate is selectively couplable to the second section of the bracket so that the grate is configured to screen debris from water that enters the inlet.

9 Claims, 4 Drawing Sheets

SWIMMING POOL DEBRIS SCREENING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to debris screening assemblies and more particularly pertains to a new debris screening assembly for preventing clogs in a pool's water flow system.

BRIEF SUMMARY OF THE INVENTION

An embodiment of the disclosure meets the needs presented above by generally comprising a bracket that is sized to partially insert into an inlet of a pool skimmer of a pool. A first section of the bracket is frictionally coupled to the inlet and a second section of the bracket extends from the inlet into the pool. A grate is selectively couplable to the second section of the bracket so that the grate is configured to screen debris from water that enters the inlet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
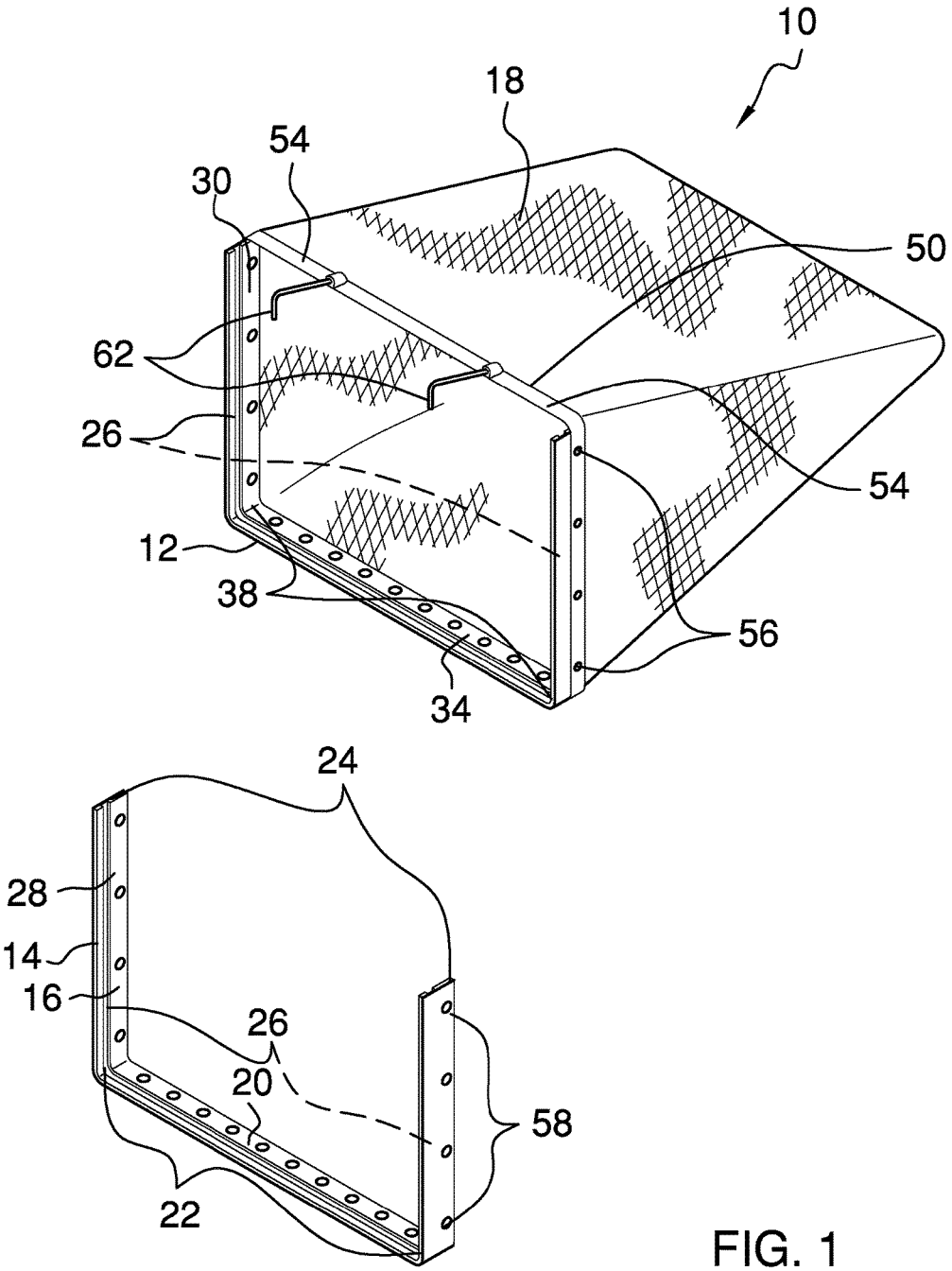
FIG. 1 is an isometric perspective view of a swimming pool debris screening assembly according to an embodiment of the disclosure.

With reference now to the drawings, and in particular to FIGS. 1 through 5 thereof, a new debris screening assembly embodying the principles and concepts of an embodiment of the disclosure and generally designated by the reference numeral 10 will be described.

Figure 3:
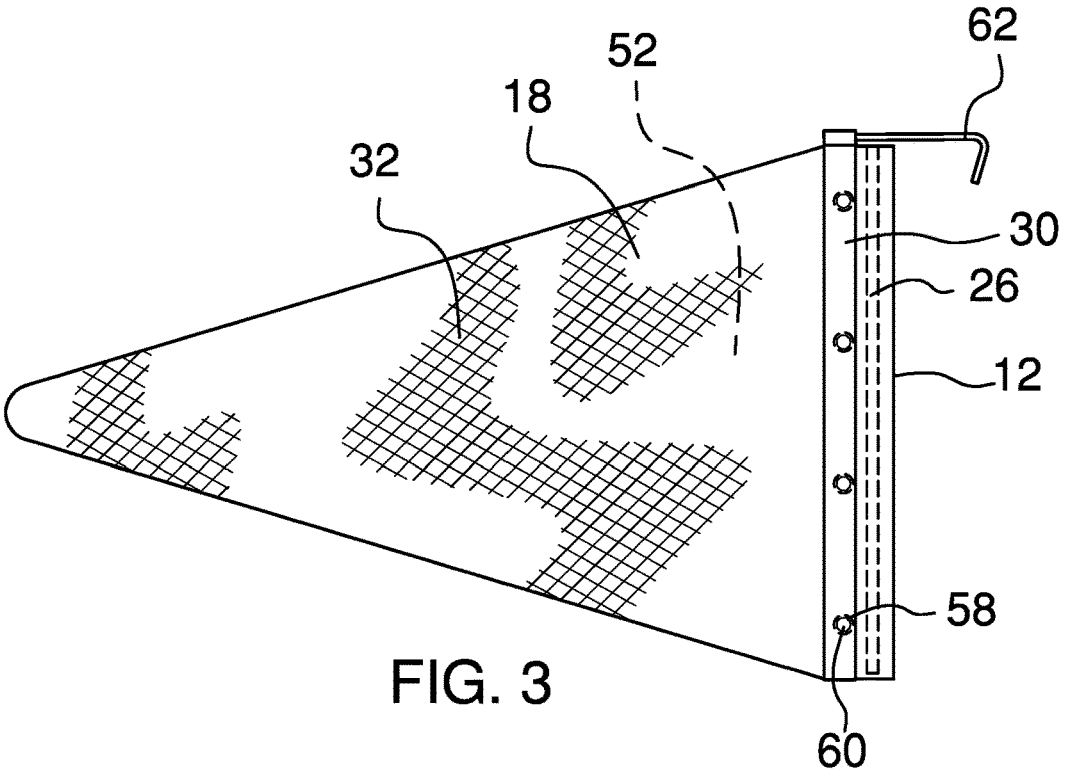
FIG. 3 is a side view of an embodiment of the disclosure.
Figure 4:
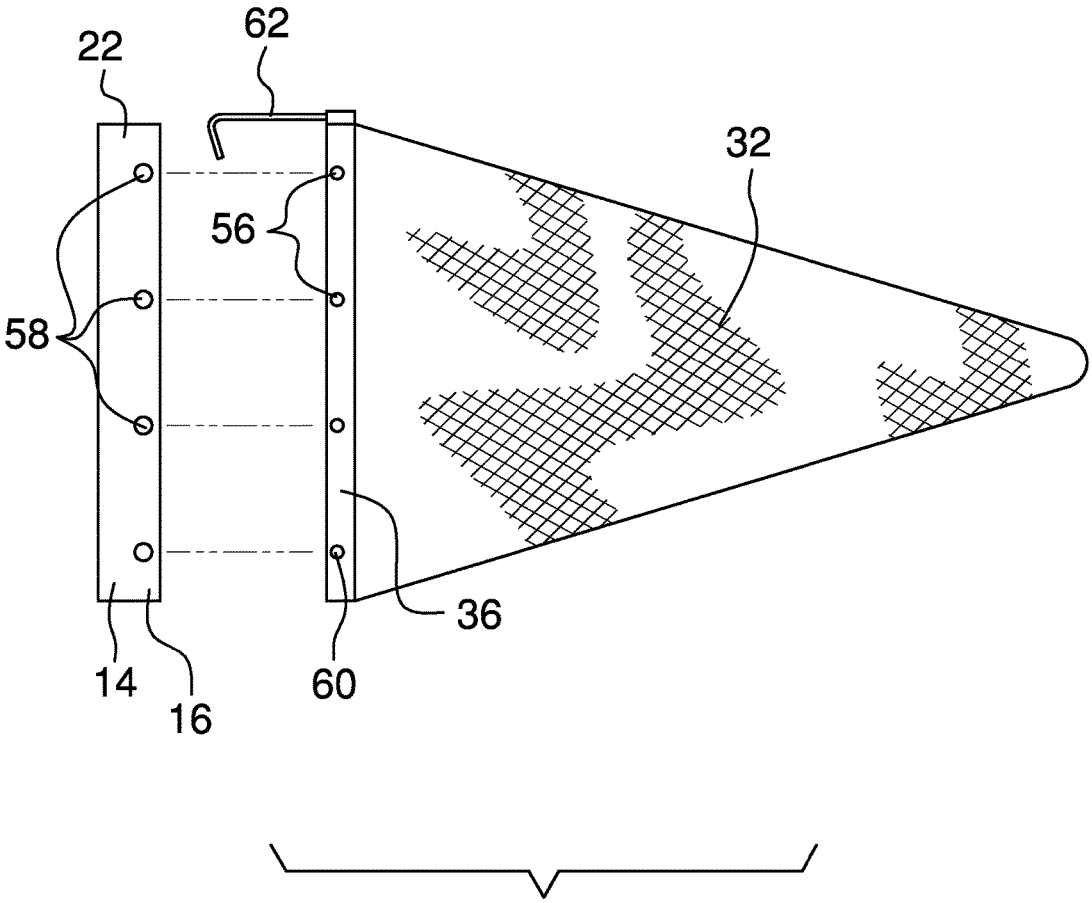
FIG. 4 is an exploded view of an embodiment of the disclosure.
Figure 5:
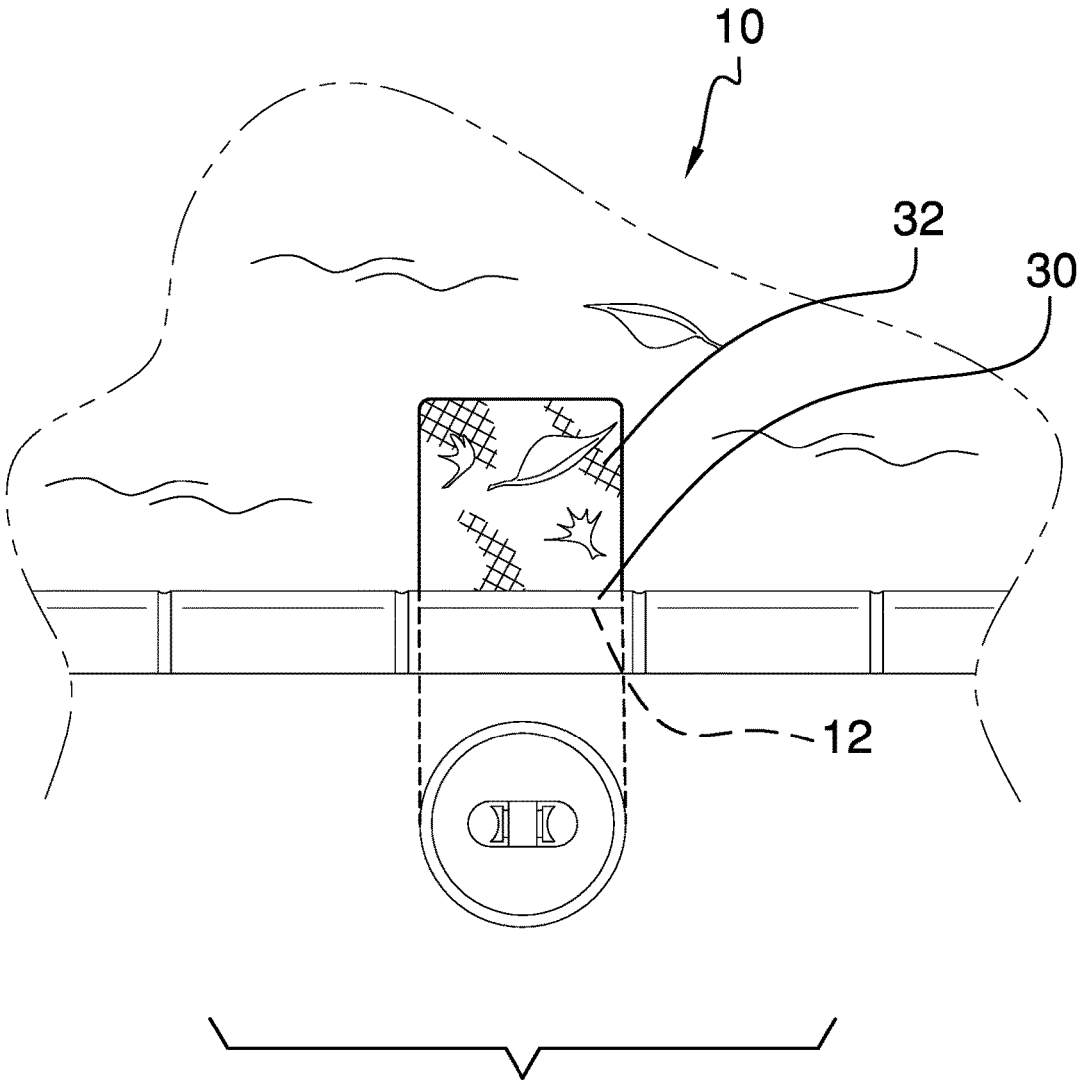
FIG. 5 is an in-use view of an embodiment of the disclosure.

As best illustrated in FIGS. 1 through 5, the swimming pool debris screening assembly 10 generally comprises a bracket 12 that is sized to partially insert into an inlet of a pool skimmer of a pool. A first section 14 of the bracket 12 is frictionally coupled to the inlet and a second section 16 of the bracket 12 extends from the inlet into the pool. A grate 18 is selectively couplable to the second section 16 of the bracket 12 so that the grate 18 is configured to screen debris, such as leaves and branches, from water that enters the inlet, as shown in FIG. 5.

Preventing the debris from entering the inlet prevents clogging of the water flow system of the pool. The assembly 10 is particularly suitable for use during extended periods of time when the pool is not in use, such as the fall and winter months, as little or no maintenance is required.

The bracket 12 comprises aluminum or the like. The bracket 12 comprises an upper bar 20 and a pair of side bars 22. Each side bar 22 is coupled to and extends perpendicularly from a respective opposing end 24 of the upper bar 20. Each of a pair of recesses 26 is positioned longitudinally in an inner face 28 of a respective side bar 22. The recesses 26 are positioned in the second section 16 of the bracket 12.

The grate 18 comprises a frame 30 and a mesh 32. The frame 30 comprises a lower bar 34 and a pair of edge bars 36. Each edge bar 36 is coupled to and extends perpendicularly from a respective opposing terminus 38 of the lower bar 34. Each edge bar 36 is positioned to slidably insert into an associated recess 26 to removably couple the frame 30 to the bracket 12, as shown in FIG. 3. The frame 30 comprises aluminum or the like.

The mesh 32 is coupled to and extends between the edge bars 36. The mesh 32 is coupled by a lower edge 40 to the lower bar 34 so that an upper edge 42 of the mesh 32 extends between the edge bars 36 distal from the lower bar 34. The mesh 32 is configured to screen the debris from the water that enters the inlet.

Figure 2:
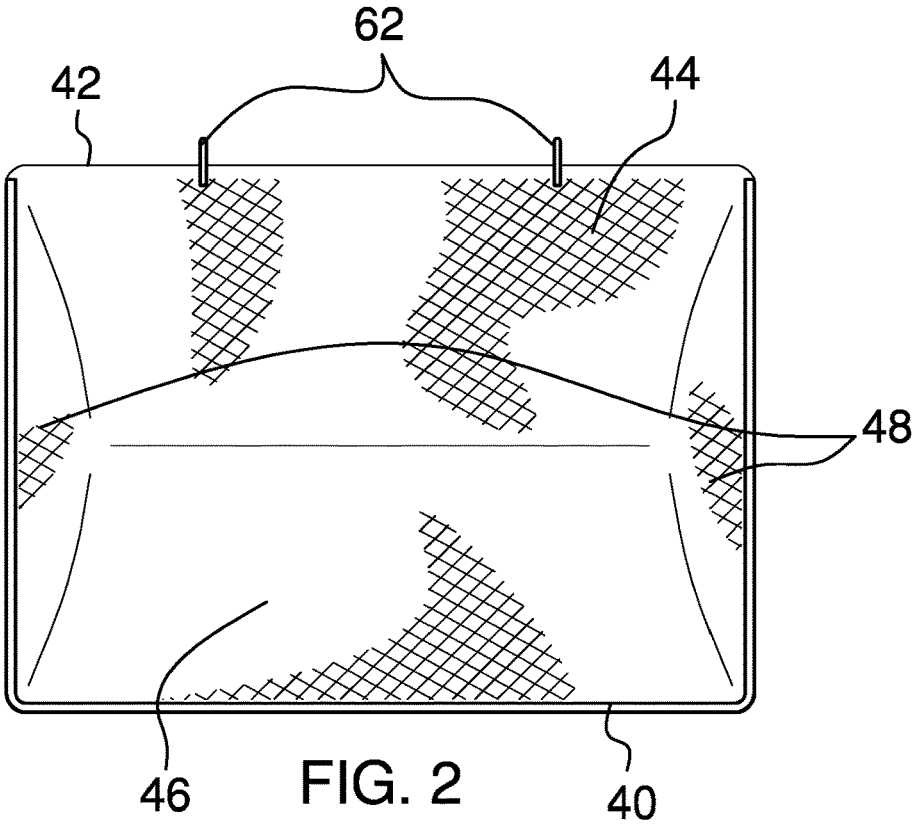
FIG. 2 is a back view of an embodiment of the disclosure.

The mesh 32 has a top 44, a bottom 46, and opposing sides 48 that define a perimeter 50 of the mesh 32 and an interior space 52. The perimeter 50 is complementary to the frame 30. The mesh 32 comprises semi-rigid plastic, or the like, so that the mesh 32 is configured to substantially maintain a three-dimensional shape. The top 44 and the bottom 46 are rectangularly shaped. The opposing sides 48 are substantially triangularly shaped so that the top 44 and the bottom 46 meet distal from the frame 30, as shown in FIG. 2.

An annular strip 54 is coupled to and extends around the perimeter 50 of the mesh 32. The annular strip 54 is coupled to the frame 30 by a plurality of rivets 56, as shown in FIG. 4. A plurality of holes 58 is positioned through the bracket 12, as shown in FIG. 4. Each hole 58 is positioned to reversibly insert a head 60 of an associated rivet 56 as the edge bars 36 are slidably inserted into the recesses 26 to removably couple the frame 30 to the bracket 12.

A pair of hooks 62 is coupled to and extends from the annular strip 54, as shown in FIG. 1. The hooks 62 are opposingly positioned to the lower bar 34. Each hook 62 is positioned to couple to the upper bar 20 of the bracket 12 to prevent the edge bars 36 from sliding within the recesses 26.

In use, the bracket 12 is inserted into the inlet to couple the bracket 12 to the inlet while leaving the second section 16 of the bracket 12 protruding into the pool. The edge bars 36 of the frame 30 are inserted into the recesses 26 to couple the frame 30 to the bracket 12. The hooks 62 are coupled to the upper bar 20 of the bracket 12 to prevent the frame 30 from sliding from the bracket 12. The mesh 32 extends into the pool and is configured to screen the debris from the water that flows from the pool into the inlet.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A swimming pool debris screening assembly comprising:

a bracket sized for partially inserting into an inlet of a pool skimmer of a pool such that a first section of the bracket is frictionally coupled to the inlet and a second section of the bracket extends from the inlet into the pool, the bracket comprising an upper bar, a pair of side bars, each side bar being coupled to and extending perpendicularly from a respective opposing end of the upper bar, and a pair of recesses, each recess being positioned longitudinally in an inner face of a respective side bar, the recesses being positioned in the second section of the bracket; and a grate selectively couplable to the second section of the bracket such that the grate is configured for screening debris from water entering the inlet, the grate comprising a frame comprising a lower bar and a pair of edge bars, each edge bar being coupled to and extending perpendicularly from a respective opposing terminus of the lower bar wherein each edge bar is positioned for slidably inserting into an associated recess for removably coupling the frame to the bracket, and a mesh coupled to and extending between the edge bars, the mesh being coupled by a lower edge to the lower bar such that an upper edge of the mesh extends between the edge bars distal from the lower bar wherein the mesh is configured for screening the debris from the water entering the inlet.

2. The assembly of claim 1, further including the bracket comprising aluminum.

3. The assembly of claim 1, further including the frame comprising aluminum.

4. The assembly of claim 3, further including the mesh having a top, a bottom and opposing sides defining a perimeter of the mesh and an interior space, the perimeter being complementary to the frame.

5. The assembly of claim 4, further including the mesh comprising semi-rigid plastic wherein the mesh is configured for substantially maintaining a three-dimensional shape.

6. The assembly of claim 5, further including the top and the bottom being rectangularly shaped, the opposing sides being substantially triangularly shaped such that the top and the bottom meet distal from the frame.

7. The assembly of claim 4, further including comprising:

an annular strip coupled to and extending around the perimeter of the mesh, the annular strip being coupled to the frame by a plurality of rivets; and a plurality of holes positioned through the bracket wherein each hole is positioned for reversibly inserting a head of an associated rivet as the edge bars are slidably inserted into the recesses for removably coupling the frame to the bracket.

8. The assembly of claim 7, further including a pair of hooks coupled to and extending from the annular strip, the hooks being opposingly positioned to the lower bar wherein each hook is positioned for coupling to the upper bar of the bracket for preventing the edge bars from sliding within the recesses.

9. A swimming pool debris screening assembly comprising:

a bracket sized for partially inserting into an inlet of a pool skimmer of a pool such that a first section of the bracket is frictionally coupled to the inlet and a second section of the bracket extends from the inlet into the pool, the bracket comprising aluminum, the bracket comprising:

an upper bar, a pair of side bars, each side bar being coupled to and extending perpendicularly from a respective opposing end of the upper bar, and a pair of recesses, each recess being positioned longitudinally in an inner face of a respective side bar, the recesses being positioned in the second section of the bracket;

a grate selectively couplable to the second section of the bracket such that the grate is configured for screening debris from water entering the inlet, the grate comprising:

a frame comprising a lower bar and a pair of edge bars, each edge bar being coupled to and extending perpendicularly from a respective opposing terminus of the lower bar wherein each edge bar is positioned for slidably inserting into an associated recess for removably coupling the frame to the bracket, the frame comprising aluminum, and a mesh coupled to and extending between the edge bars, the mesh being coupled by a lower edge to the lower bar such that an upper edge of the mesh extends between the edge bars distal from the lower bar wherein the mesh is configured for screening the debris from the water entering the inlet, the mesh having a top, a bottom and opposing sides defining a perimeter of the mesh and an interior space, the perimeter being complementary to the frame, the mesh comprising semi-rigid plastic wherein the mesh is configured for substantially maintaining a three-dimensional shape, the top and the bottom being rectangularly shaped, the opposing sides being substantially triangularly shaped such that the top and the bottom meet distal from the frame, and an annular strip coupled to and extending around the perimeter of the mesh, the annular strip being coupled to the frame by a plurality of rivets;

a plurality of holes positioned through the bracket wherein each hole is positioned for reversibly inserting a head of an associated rivet as the edge bars are slidably inserted into the recesses for removably coupling the frame to the bracket; and a pair of hooks coupled to and extending from the annular strip, the hooks being opposingly positioned to the lower bar wherein each hook is positioned for coupling to the upper bar of the bracket for preventing the edge bars from sliding within the recesses.

* * * * *